US009567939B2

(12) United States Patent
Pouring et al.

(10) Patent No.: US 9,567,939 B2
(45) **Date of Patent: *Feb. 14, 2017**

(54) THERMALLY STRATIFIED REGENERATIVE COMBUSTION CHAMBER

(71) Applicant: SONEX RESEARCH, INC., Annapolis, MD (US)

(72) Inventors: Andrew Pouring, Edgewater, MD (US); Matthew Hayes, Tracy's Landing, MD (US); Brad Bopp, Stevensville, MD (US); Manfred Weber, Greensboro, MD (US); Michael Keller, Alexandria, VA (US)

(73) Assignee: SONEX RESEARCH, INC., Annapolis, MD (US)

( * ) Notice: Subject to any disclaimer, the term of this patent is extended or adjusted under 35 U.S.C. 154(b) by 407 days.

This patent is subject to a terminal disclaimer.

(21) Appl. No.: 14/166,676

(22) Filed: Jan. 28, 2014

(65) Prior Publication Data

US 2014/0209058 A1 Jul. 31, 2014

Related U.S. Application Data

(60) Provisional application No. 61/757,383, filed on Jan. 28, 2013.

(51) Int. Cl.

| | |
|---|---|
| ***F02B 75/08*** | (2006.01) |
| ***F02F 1/00*** | (2006.01) |
| *F02F 1/24* | (2006.01) |

(52) U.S. Cl.

CPC ..... *F02F 1/00* (2013.01); *F02F 2001/249* (2013.01); *F05C 2251/046* (2013.01); *F05C 2251/048* (2013.01); *Y10T 29/49233* (2015.01)

(58) Field of Classification Search

CPC ..... F02F 1/24; F02B 23/00; F02B 2013/0609

(Continued)

(56) References Cited

U.S. PATENT DOCUMENTS

| | | |
|---|---|---|
| 2,148,357 A | 2/1939 | Johnson |
| 2,514,287 A | 7/1950 | Mueller |

(Continued)

FOREIGN PATENT DOCUMENTS

| | | |
|---|---|---|
| EP | 0 120 223 A2 | 10/1984 |
| GB | 911125 | 11/1962 |
| WO | 2009114327 | 9/2009 |

OTHER PUBLICATIONS

International Search Report and Written Opinion of the International Searching Authority regarding International Application No. PCT/US2014/013432, mailed May 21, 2014.

(Continued)

*Primary Examiner* — John Kwon

(74) *Attorney, Agent, or Firm* — Workman Nydegger

(57) ABSTRACT

A method for improving combustion in a combustion chamber of an internal combustion engine, a heat retaining element, and an internal combustion engine are provided. The internal combustion engine includes a main combustion chamber arranged between a head and a reciprocating piston, and a heat retaining element provided between the head and the main combustion chamber. The heat retaining element is a self-supporting structure coupled to the head that is configured to reduce heat transfer from the main combustion chamber into the engine head. The heat retaining element includes a head-facing portion substantially corresponding in shape to a portion of the head facing the main combustion chamber. The heat retaining element is provided such that a gap is provided between the head-facing portion (Continued)

of the heat retaining element and the portion of the head facing the main combustion chamber.

18 Claims, 5 Drawing Sheets

(58) Field of Classification Search
USPC ..... 123/193.1, 193.3, 195.5, 668, 669, 671, 123/254, 270, 271
See application file for complete search history.

(56) References Cited

U.S. PATENT DOCUMENTS

| | | | | |
|---|---|---|---|---|
| 2,917,226 | A | 12/1959 | Scheiterlein | |
| 3,092,088 | A | 6/1963 | Goossak et al. | |
| 3,115,127 | A | 12/1963 | Spencer et al. | |
| 3,230,939 | A | 1/1966 | Goossak | |
| 3,283,751 | A | 11/1966 | Goossak et al. | |
| 4,091,772 | A | 5/1978 | Heater et al. | |
| 4,519,359 | A | 5/1985 | Dworak et al. | |
| 4,592,318 | A | 6/1986 | Pouring | |
| 4,592,331 | A | 6/1986 | Pouring | |
| 4,681,072 | A | 7/1987 | Pouring | |
| 4,788,942 | A | 12/1988 | Pouring et al. | |
| 4,827,887 | A | 5/1989 | Leshner | |
| 4,898,135 | A | 2/1990 | Failla et al. | |
| 5,010,861 | A * | 4/1991 | Matsuoka | F02B 19/165 123/254 |
| 5,052,356 | A | 10/1991 | Blaser | |
| 5,095,869 | A | 3/1992 | Blaser et al. | |
| 5,117,788 | A | 6/1992 | Blaser | |
| 5,322,042 | A | 6/1994 | Di Priolo et al. | |
| 5,645,028 | A * | 7/1997 | Matsuoka | F02B 23/0603 123/276 |
| 5,730,096 | A | 3/1998 | Atmur et al. | |
| 5,778,849 | A * | 7/1998 | Regueiro | F02B 19/1004 123/254 |
| 5,855,192 | A | 1/1999 | McCowan et al. | |
| 5,862,788 | A | 1/1999 | Pouring et al. | |
| 6,178,942 | B1 | 1/2001 | Di Priolo et al. | |
| 6,354,260 | B1 | 3/2002 | Newsom et al. | |
| 8,567,369 | B2 | 10/2013 | Johnson | |
| 8,857,405 | B2 | 10/2014 | Attard | |
| 2008/0041333 | A1 * | 2/2008 | Jarrett | F02F 3/0023 123/254 |
| 2010/0319655 | A1 | 12/2010 | McClendon | |
| 2011/0232589 | A1 | 9/2011 | Blank | |
| 2012/0103302 | A1 | 5/2012 | Attard | |
| 2012/0118262 | A1 | 5/2012 | Johnson | |

OTHER PUBLICATIONS

David A. Blank, SAE Paper 2011-01-1895 "Combustion Control Chemical-Kinetics Studies with Natural Gas in HCRI Enhanced Four-Stroke DI SI", p. 1-15, 2011, Society of Automotive Engineers of Japan, Inc.

David A. Blank, SAE Paper 2011-01-2025 "A Novel Two-Stroke SI Design for Nox Reduction in Natural Gas RI Species Enhanced Engine", p. 1-15, 2011, Society of Automotive Engineers of Japan, Inc.

David A. Blank, SAE Paper 2011-26-0005 "Nox Reduction in Natural Gas RI Species Augmented Large Bore Four-Stroke SI Engines", 1-16, 2011, SAE International.

"An ASME Historic Mechanical Engineering Landmark"; ASME History and Heritage Committee; Aug. 26, 2006.

Bourn, Gary D., et al. "Advanced Compressor Engine Controls to Enhance Operation , Reliability , and Integrity" Southwest Research Institute, San Antonio, TX, USA, per Doe Award No. DE-FC26-03NT41859, SwRi Project No. 03.10198, Mar. 2004.

Engines and Energy Conversion Lab et al. "ERLE Cost Study of the Retrofit Legacy Pipeline Engines to Satisfy 1/2 g/BHP-HR NOx," Rev.1, May 21, 2009.

* cited by examiner

THERMALLY STRATIFIED REGENERATIVE COMBUSTION CHAMBER

FIELD

The present disclosure relates generally to the field of reciprocating piston engines, and more particularly relates to an improvement for a combustion chamber of an internal combustion engine that overcomes certain lean-burn combustion problems encountered by conventional engines from heat transfer between the combustion chamber and the engine head area during engine operation.

BACKGROUND

A review of reciprocating piston, internal combustion engine art reveals various attempts to improve lean-burn combustion in the combustion chamber of such engines by utilizing prechambers to initiate a torch-like output to cause ignition in lean-burn air/fuel mixtures.

SUMMARY

A method is provided for improving combustion in a combustion chamber of a reciprocating piston internal combustion engine. The engine includes a main combustion chamber arranged between a head and a reciprocating piston. The method includes providing a heat retaining element between the head and the main combustion chamber, the heat retaining element being configured to reduce heat transfer from the main combustion chamber into the engine head. The heat retaining element is a self-supporting structure coupled to the head. The heat retaining element includes a head-facing portion substantially corresponding in shape to a portion of the head facing the main combustion chamber. The heat retaining element is provided such that a gap is formed between the head-facing portion of the heat retaining element and the portion of the head facing the main combustion chamber.

A heat retaining element is provided, the heat retaining element being configured to be installed between a head and a main combustion chamber of an internal combustion engine, the combustion chamber of the engine being between a head and a reciprocating piston. The heat retaining element is configured to reduce heat transfer from the main combustion chamber into the engine head. The heat retaining element is a self-supporting structure coupled to the head and includes a head-facing portion substantially corresponding in shape to a portion of the head facing the main combustion chamber. The heat retaining element is provided such that a gap is formed between the head-facing portion of the heat retaining element and the portion of the head facing the main combustion chamber.

The numerous other advantages, features and functions of embodiments of a method for improving start-up and operating combustion in a main combustion chamber of a reciprocating piston internal combustion engine and embodiments of a resulting improved engine will become readily apparent and better understood in view of the following description and accompanying drawings. The following description is not intended to limit the scope of the method for improving start-up and operating combustion in a main combustion chamber of a reciprocating piston internal combustion engine and embodiments of a resulting improved engine, but instead merely provides exemplary embodiments for ease of understanding.

A feature of the embodiments and examples described herein includes a method of improving start-up and operating lean-burn combustion in a main combustion chamber of a reciprocating piston, internal combustion engine having, for example, a main block and a fluid-cooled head, such combustion chamber being as defined by a variable volume above each engine piston, wherein the following steps are provided:

(a) a heat retaining element distinct from the engine main block and head located within the head of the engine is provided that retains heat of combustion of each combustion cycle for transfer to charge of a subsequent combustion cycle.

(b) the heat retaining element is installed in the head as a self-supporting structure having a head facing portion having a shape substantially corresponding to the shape of that portion of the main combustion chamber defined by the head with a clearance gap between at least said head facing portion and the head before engine operation, with the size of said clearance gap being arranged to be varied in dependence on temperature of the heat retainer after engine start-up, so that the heat transfer rate between the heat transfer element and the head is varied as a function of the size of the clearance gap during engine operation to optimize the rise in temperature of a layer of air/fuel in contact with the heat retaining element during the latter stage of the compression stroke.

The size of the clearance gap of step (b) is varied by using natural thermal expansion and contraction of the heater retainer within the head during engine operation. The gap may be reduced down to zero during engine operation to effectively cause increased heat transfer between the heat retainer and the head under engine operation conditions that cause high heating of the heat retainer while maintaining the ability to transfer heat to a layer of air/fuel in contact with the element.

The engine head and heat retainer have respectively a head and heat retainer thermal diffusivity, a head and heat retainer thermal capacity, and a head and heat retainer heat transfer coefficient. The heat retainer is constructed from a material that has at least one of: a lower heat retainer thermal diffusivity than said head thermal diffusivity, a heat retainer heat capacity greater than said head heat capacity, and a heat retainer heat transfer coefficient lower than said head heat transfer coefficient. The engine that is suitable for use of the present disclosure may be a fluid-cooled, two-stroke, direct injected, natural gas fuel lean-burning, engine that in one configuration preferably includes, at the head of the engine, a precombustion chamber having a volume, with the precombustion chamber being provided with a spark igniter within the precombustion chamber volume, and receiving a charge of secondary air/fuel each combustion cycle of the engine.

The precombustion chamber volume communicates with the main combustion chamber via one or more jet orifices or ports, through which is discharged through said orifice a burning flame jet of ignited secondary charge or high energy radicals resulting from partial combustion of a secondary charge in the precombustion chamber into the main charge that has been, or is being, compressed each combustion cycle of the engine to cause ignition of each main charge in the main combustion chamber. The combustion chamber may be turbocharged, supercharged or naturally aspirated. Such engine typically will run at relatively low RPM, and at relatively low compression ratio, thereby resulting in relatively low combustion chamber temperatures that aggravate cold starting of the engine and instable combustion in terms of peak firing pressure timing over sequential combustion cycles. In a second configuration, the precombustion chamber is omitted. The ignition event is provided by one or more spark plugs in the main chamber. The heat retaining element has raised the temperature of the layer of air/fuel mixture to thereby promote the rapid growth of the flame kernel to stabilize the flame propagation.

Another aspect of the disclosure is an internal combustion engine adapted to use the above-described process, the engine including a block, one or more reciprocating pistons in the block, a fluid-cooled head, a main combustion chamber defined by the block and the head above each piston, each main combustion chamber portion defined by the head having a selected head chamber shape, and the described heat retainer preferably comprising in one embodiment, specifically a self-supporting structure secured in the head between the head and each respective piston, said heat retainer having at least a front surface facing towards a respective piston and a rear surface that faces the head and a least in part conforms substantially with the head chamber shape, at least a portion of said rear surface spaced from the head to define a gap before engine operation.

The heat retainer preferably is formed of a material and is configured so that the heat retainer expands as a function of combustion heat during engine operation to reduce the gap and thereby increase at least a rate of heat transfer between the heat retainer and the water-cooled head as a function of combustion heat during engine operation. The gap reduction in such engine may extend to zero. The head and heat retainer preferably also have respectively a head and heat retainer thermal diffusivity, a head and heat retainer thermal capacity, and a head and heat retainer heat transfer coefficient, with the heat retainer being constructed of a material that has at least one of: a lower heat retainer thermal diffusivity than said head thermal diffusivity, a heat retainer heat capacity greater than said head heat capacity, and a heat retainer heat transfer coefficient lower than said head heat transfer coefficient.

The heat retainer in the afore described configurations creates what may be termed a "thermally stratified regenerative combustion chamber" in the sense that the heat retainer transmits or conducts heat of combustion from each combustion cycle into the engine block and head in different manners and rates, with lower temperatures occurring near the intersection of the head and block of the engine, or near the lower part of the combustion chamber, with higher temperatures occurring at the mid and top part of the heat retainer that may be spaced from the cooled head of the engine, at least until the heat retainer has expanded into contact with the head, at which point the separation gap would be zero. The mid and top part of the combustion chamber thus would function at a higher temperature than the lower part of the combustion chamber. The engine designer is thereby provided with a design tool to adjust the operating temperature of the combustion chamber to influence the characteristics of the lean-burn by designing the heat retaining element, including the material constituting the heat retaining element, and the gap in a manner that can produce a customized thermally stratified regenerative combustion chamber which will be useful to control lean-burn combustion events within the combustion cycle of the engine.

In the engine, a spark igniter may be provided in each main combustion chamber as afore described preferably connected directly to the heat retainer. The engine contemplated, moreover, will be a reciprocating piston, water-cooled, two-stroke, direct injected (or other fueling means, such as fuel fumigation), natural gas fuel lean-burning engine, that normally includes at the head of the engine adjacent each main combustion chamber a precombustion chamber having a volume, the precombustion chamber being arranged to receive in said volume a charge of secondary air/fuel during each combustion cycle of the engine, a spark igniter in the precombustion chamber arranged to be cyclically ignited in timed relationship with the combustion cycle of the engine. The precombustion chamber will communicate with a respective main combustion chamber via one or more jet orifices or ports through which a burning flame jet of secondary charge ignited by said spark igniter or high energy radicals resulting from partial combustion of the secondary charge in the precombustion chamber is periodically discharged into the main charge that has been, or is being, compressed each combustion cycle of the engine to ignite each main lean charge in the main combustion chamber.

The numerous other advantages, features, and functions of embodiments of a method for improving start-up and operating combustion in a main combustion chamber of a reciprocating piston internal combustion engine and embodiments of a resulting improved engine will become readily apparent and better understood in view of the following description and accompanying drawings. The following description is not intended to limit the scope of the method for modifying or resulting modified engine and the components thereof, but instead merely provides exemplary embodiments for ease of understanding.

BRIEF DESCRIPTION OF THE DRAWINGS

These and other features, aspects, and advantages of the present disclosure will become better understood with regard to the following description, appended claims, and accompanying drawings where:

Figure 1:
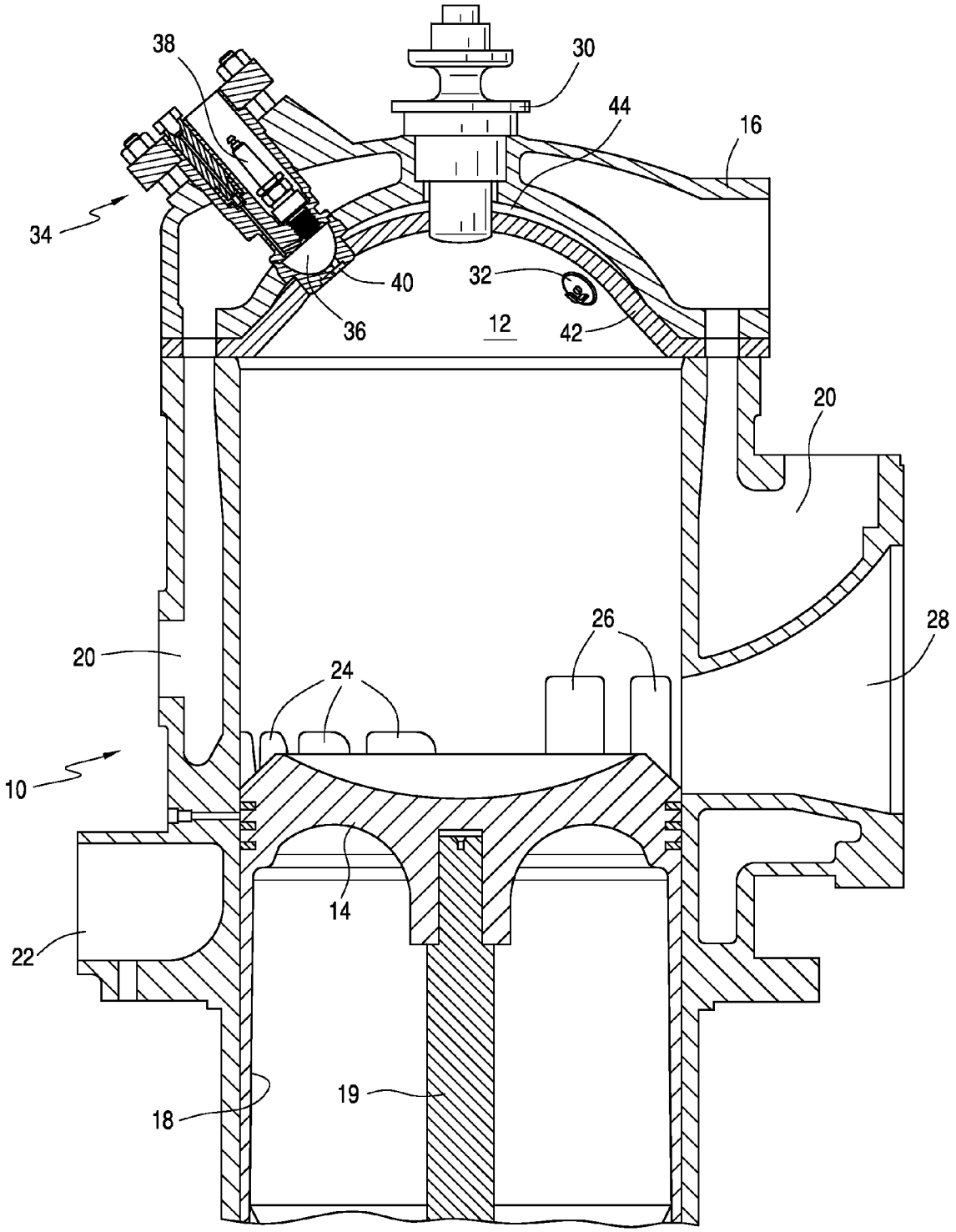
FIG. 1 is a schematic vertical cross-section view of a combustion chamber of an exemplary two-stroke, direct injected, water-cooled, natural gas lean-burning, reciprocating piston engine having installed therein an embodiment of a heat retainer.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of method for modifying or resulting modified engine and the components thereof, and in no way limit the structures or configurations method for modifying or resulting modified engine and the components thereof according to the present disclosure.

DETAILED DESCRIPTION

With reference to FIG. 1, a representative or exemplary engine block 10 is shown in vertical cross-section to expose a main combustion chamber 12 lying between a reciprocating piston 14 and a head 16. The piston 14 reciprocates in a cylinder 18 in the block 10, and in a typical engine, a plurality of such pistons and cylinders will be provided within the block. The piston is connected by a connecting rod 19 to an output crankshaft (not shown) and both the block 10 and head 16 of the engine are typically liquid cooled, the coolant circulating through coolant passages 20 in the head 16 and block 10.

The engine represented in the drawing is a two-cycle engine, with air supplied via an air inlet 22 communicating with inlet ports 24 and exhaust discharged via exhaust ports 26 communicating with exhaust outlet 28 in a conventional manner, such engines being typical and known to internal combustion engine designers.

Fuel for each combustion charge, in this example, a gaseous fuel such a natural gas, is supplied by direct injection via fuel injector 30 in timed relationship with each compression event in the main combustion chamber 12, so that at ignition of the charge the appropriate air/fuel ration is established for proper ignition and combustion in a conventional manner.

For ignition, both a spark igniter 32 and a precombustion chamber igniter 34 may be used, with the precombustion chamber including a precombustion chamber proper 36 to which a rich mixture of air/fuel precombustion charge is supplied (not shown), and in which the precombustion charge is ignited by a precombustion spark igniter 38. Upon ignition of the precombustion charge in timed relationship with the intended combustion event in the main combustion chamber 12, a high energy jet of ignited precombustion charge is discharged in a jet stream through one or more precombustion chamber outlet orifices 40 that provide communication between the precombustion chamber proper 36 and the main combustion chamber 12. The high energy jet of flame or partially combusted radicals of fuel is used to ignite the main charge in the main combustion chamber in a conventional manner. The spark igniter 32 (see detail in FIG. 2) in such an engine may be used to ignite each charge during start-up of a cold engine, or may be used under operating conditions requiring such ignition or combustion enhancement. In addition as previously described, the precombustion chamber may be omitted.

In summary, the motion of the piston after start-up rotation of the engine crankshaft (not shown) forces air into the main combustion chamber 12 via the inlet ports 24, which air may be pressurized (turbocharged or supercharged), or naturally aspirated or circulated, and gaseous fuel is injected directly into the main combustion chamber 12 via the fuel injector 30. The precombustion chamber 36 receives a precombustion charge of air and fuel and ignites the same by a precombustion spark igniter 32 to produce a hot, highly energetic jet of gas aimed at the main combustion chamber 12 which in turn ignites the charge now in the main combustion chamber 12 in timed relationship with the intended combustion cycle of the engine. Coolant circulates through the block 10 and head 16 to control the temperature of the structures and inherently the temperature of the main combustion chamber 12 to varying degrees, depending on the location being considered within the combustion chamber.

A regenerative heat retainer 42 is disposed in the head 16 of the engine between the head proper and the piston below, so that the main combustion chamber 12 now is defined by the volume between the heat retainer 42, the piston 14 and the cylinder 18. The heat retainer is configured to essentially conform in shape to the original head area of the main combustion chamber 12, but with a selected gap 44 between the heat retainer 42 and the liquid cooled head 16. The heat retainer is also configured to preserve the original compression ratio of the engine, although the engine designer could alter the compression ratio using the heat retainer if desired, simply by increasing or reducing the volume of the main combustion chamber by altering the size of the heat retainer 42.

Figure 3A:
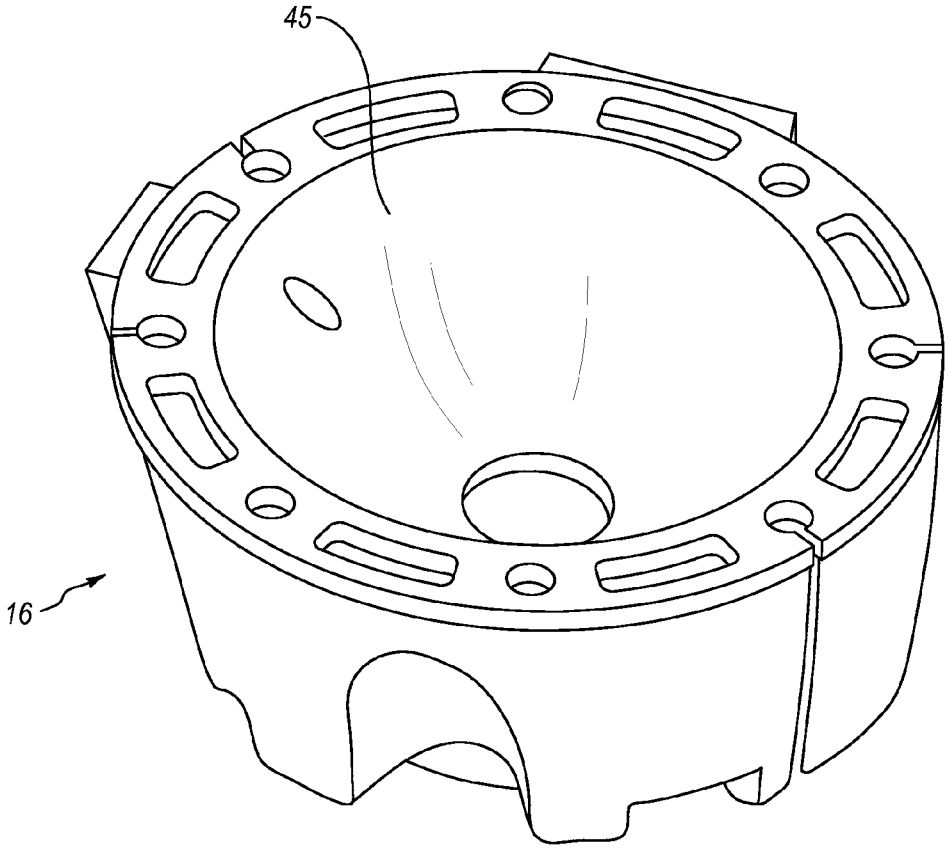
FIGS. 3*a* and 3*b* show an embodiment of a shape of a head facing portion of a heat retainer corresponding to a shape of a portion of the head facing the main combustion chamber.
Figure 3B:
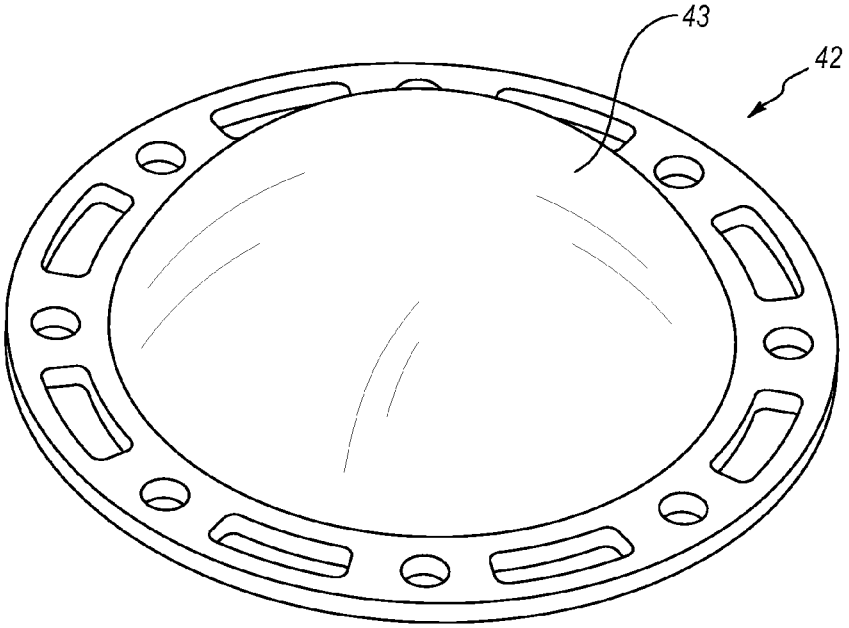

The heat retainer 42 is installed in the head 16 as a self-supporting structure having a head-facing portion 43 having a shape substantially corresponding to the shape of that portion 45 of the main combustion chamber defined by the head with a clearance gap between at least said head-facing portion and the head before engine operation, as shown in the overturned head 16 showing the portion 45 of the head facing the main combustion chamber in FIG. 3*a* and the heating retainer 42 having head-facing portion 43 in FIG. 3*b*.

The material and thermal properties of the head will be taken into account in designing the heat retainer 42, and the following considerations will be evaluated or implemented when designing and installing the heat retainer 42.

It will be assumed that the head 16 possesses a known head thermal diffusivity, head thermal capacity and head heat transfer coefficient, all thermal properties that may be calculated or derived from known information and data, depending on the material of the head. On the basis of such head thermal properties, the regenerative heat retainer will be configured to have a lower heat retainer thermal diffusivity than said head thermal diffusivity, a heat retainer heat capacity greater than said head heat capacity, and a heat retainer heat transfer coefficient lower than said head heat transfer coefficient.

This will result in retention of heat of combustion within the main combustion chamber in which the heat retainer is installed to a greater extent than occurred in the unmodified main combustion chamber 12. With the gap 44 provided between the heat retainer 42 and the head 16, the modified main combustion chamber with the heat retainer also will be thermally stratified between the lower and upper parts of the combustion chamber, with the relatively cooler part of the combustion chamber located at the lower part thereof, and the hotter part near the top area thereof. This feature enables the engine designer to take into account the ignition and combustion properties of the air/fuel charge in the main combustion chamber, the direction of the precombustion jet discharged from the precombustion chamber and other effects that may be desirable towards enhancing the efficiency of combustion of the engine or uniformity of the peak firing pressures over sequential combustion cycles. The gap 44 is varied as a function of operating temperature within the main combustion chamber 12 due to the expansion and contraction of the heat retainer 42, thereby providing another control function over the operating temperature of the main combustion chamber 12. When the gap 44 is zero, of course, the liquid cooled head 16 contacts the heat retainer at its upper end and cools the heat retainer in that area, resulting eventually in contraction of the heat retainer to reopen the gap 44, with the cycle repeating depending on operating conditions of the engine.

Although the heat retainer 42 is described herein as provided with a water-cooled head, it is not limited to use with a water-cooled head, but may be provided in an engine including engines cooled by other liquids or an air-cooled head, or a head cooled by other various mechanisms or even with uncooled engines.

Figure 4:
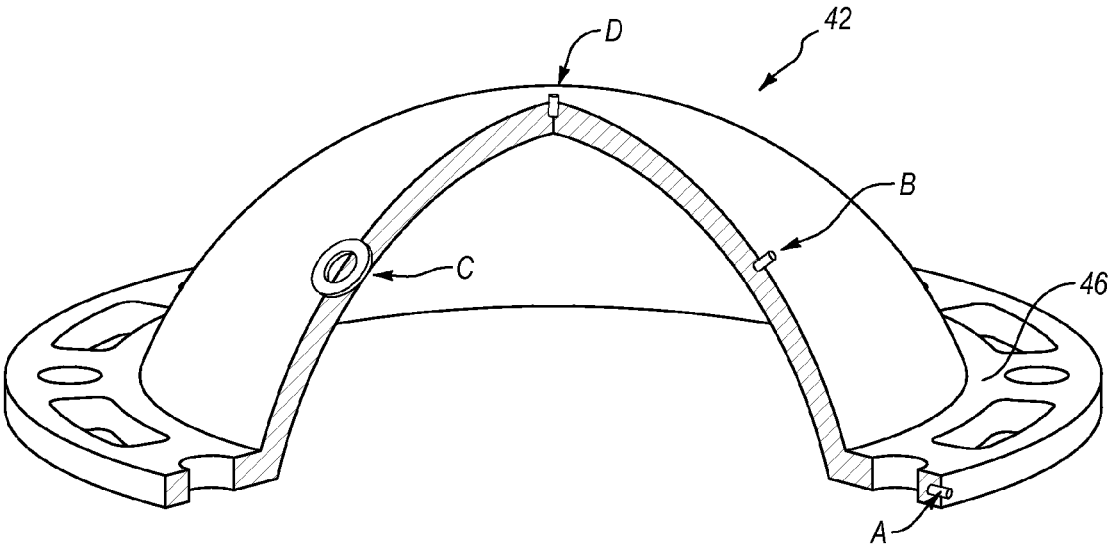
FIG. 4 shows an example of a thermally stratified regenerative combustion chamber.

The heat retainer in the afore described configurations creates what may be termed a "thermally stratified regenerative combustion chamber" in the sense that the heat retainer transmits or conducts heat of combustion from each combustion cycle into the engine block and head in different manners and rates. As shown in FIG. 4, lower temperatures occur near the intersection of the head and block of the engine, or near the lower part of the combustion chamber, for example, as position A on flange 46 of heat retainer 42. Higher temperatures occurring at the mid and top part of the heat retainer 42 may be spaced from the cooled head of the engine, at least until the heat retainer has expanded into contact with the head, at which point the separation gap would be zero. The mid, for example at position B and top part of the combustion chamber at position D thus function at a higher temperature than the lower part of the combustion chamber. The engine designer is thereby provided with a design tool to adjust the operating temperature of the combustion chamber to influence the characteristics of the lean-burn by designing the heat retaining element, including the material constituting the heat retaining element, and the gap in a manner that can produce a customized thermally stratified regenerative combustion chamber which will be useful to control lean-burn combustion events within the combustion cycle of the engine.

In the engine, a spark igniter 32 may be provided in each main combustion chamber as afore described preferably connected directly to the heat retainer. For example, as shown in FIG. 4, spark igniter 32 may be positioned at position C.

In one example during operation of a natural gas fuel burning internal combustion engine, thermocouples were placed at positions A, B, C, and D, as shown in FIG. 4. During operation, the thermocouples measured a temperature of 103° C. at position A, 294° C. at position B, 229° C. at position C, and 210° at position D.

The engine contemplated, moreover, will be a reciprocating piston, water-cooled, two-stroke, direct injected, natural gas fuel lean-burning, engine that normally includes at the head of the engine adjacent each main combustion chamber a precombustion chamber 36 having a volume, the precombustion chamber being arranged to receive in said volume a charge of secondary air/fuel during each combustion cycle of the engine, a spark igniter in the precombustion chamber arranged to be cyclically ignited in timed relationship with the combustion cycle of the engine. The precombustion chamber will communicate with a respective main combustion chamber via one or more jet orifices or ports 40 through which a burning flame jet of secondary charge ignited by said spark igniter or high energy radicals resulting from partial combustion of the secondary charge in the precombustion chamber is periodically discharged into the main charge that has been, or is being, compressed each combustion cycle of the engine to ignite each main lean charge in the main combustion chamber 12.

The engine as modified or constructed in accordance with the embodiments described herein will run with lower exhaust gas NOx, lower rate of misfire, lower fuel consumption, lower coefficient of variation (COV) of the location of Peak Firing Pressure over the operating range of the engine, lower COV Indicated Mean Effective Pressure (IMEP) over the operating range of the engine. The better control and utilization over thermal transfer of heat of combustion by the thermally stratified regenerative combustion chamber results in the above characteristics of such an engine.

Figure 2:
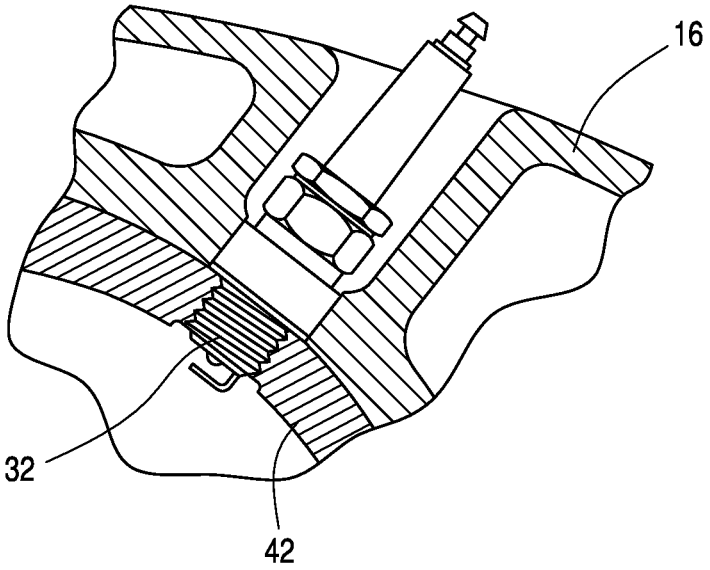
FIG. 2 is a detail view of a spark igniter directly connected to the heat retainer.

In an exemplary engine, the head 16 could be made of cast iron and the regenerative heat retainer 42 could be made of a self-supporting machined or otherwise shaped steel, with the spark igniter 32, for example, threaded directly into the heat retainer 42 as shown in the detail of FIG. 2. The fuel injector 30 likewise could be directly threaded to the heat retainer 42 as shown in FIG. 1. The heat retainer 42 would be sealed against leakage by direct metal-to-metal contact or by appropriate gasket material as needed. The thickness of the heat retainer 42 would be determined by appropriate calculation and iteratively based on the materials of the head 16 and heat retainer 42, as well as the combustion chamber operating conditions, fuel used in the charges and other relevant parameters for any given engine so that the thermal diffusivities, heat capacities, heat transfer coefficients of the head 16 and heat retainer 42 would be matched to achieve the purposes set forth above.

Although heat retainer 42 may be made of machined or otherwise shaped steel, as described above, heat retainer 42 may also be made of various steel or steels, or other metals, alloys, or materials, either machined, cast, shaped, or otherwise formed. For example, heat retainer 42 may be made of aluminum or an aluminum alloy, titanium, a magnesium alloy, or an alloy including at least one of chromium, nickel, iron, molybdenum, cobalt, or tungsten.

The embodiments described herein have particular advantages when applied to a two-stroke, reciprocating piston, natural gas lean-burning, integrated engine-compressor as exemplified by legacy Cooper-Bessemer engines (e.g. Cooper-Bessemer Type GMV Integral-Angle Gas Engine-Compressor) that compress and pump natural gas from gas fields or storage units through gas transmission lines to other storage stations or end users. Such engines make substantial horsepower while operating at relatively low RPM on the order of 300-500 RPM and compression ratios of 4-8 to one. These so called "legacy" engines are notorious for difficult starting and stable running when cold started, run with peak firing pressure variation that is less than desirable, suffer from bearing wear due to such operating characteristics, poor ignition resulting from uneven charge mixture variations and heating, and undesirable NOx and CO emissions. These engines use a precombustion chamber with igniter and hot burning jets discharged from the precombustion chambers to ignite each charge, without assistance from a spark igniter in the main combustion chamber after start-up.

Although various embodiments and examples disclosed herein describe heat retainer 42 being used in a natural gas fuel burning engine, heat retainer 42 is not limited to natural gas fuel burning engines, but may also be used in engines using other gaseous fuels, including, but not limited to, natural gases having various amounts of methane, high-methane natural gas, ethane, propane, or any mixture of these or other gaseous fuels. Further, heat retainer 42 may be implemented in other engines fueled by other forms of fuel, such as liquid fuels, including, but not limited to, gasoline, kerosene, diesel fuel, JetA, JP4, JP5, JP8, JP10, methanol, ethanol, or any mixture of these or other liquid fuels.

Another advantage of the described embodiments is the promotion of Enhanced Radical Ignition (ERI). ERI is a combination of two concepts: radical ignition (RI) assisted by a regenerative heat retaining element (RHRE), the heat retaining element acting as an in-cylinder heat source required to enable auto-ignition because of the low compression ratio/temperature inherent in 2-stroke Legacy engines. Without the presence of the high temperature RHRE, it has been shown by simulation that radical species created in a modified PCC (MPCC), fail to fully ignite fuel injected into the combustion chamber and misfire occurs.

The ERI process with NOx producing flame front eliminated is applicable to 2-stroke engines using modified radical producing MPCCs. To eliminate the flame front, ignition must start throughout the combustion chamber in what is sometimes called a "volume mode" of combustion. Accomplishing this at the "cold" starting temperature of the low compression ratios of the Legacy's requires an in-cylinder heat source rather than increased compression ratio. Improved performance, based on RHRE has documented in a large-bore engine, for example, a 8.5 inch AJAX® brand DP42 NG engine.

Additionally, improved performance, based on RHRE has been shown with Small Development Engine (SDE), for example, with 2.5 inch bore has also been documented.

Regenerative Heat Retaining Element (RHRE) has also proven useful in state-of-the-art engines, for example those used in 2-stroke Unmanned Vehicle Engines (UAV) using heavy fuels. RHRE engines have been built and tested yielding exceptionally stability, reduction in emissions and fuel consumption.

In RHRE Legacy engines, after a brief start-up on spark-ignition (or after later refinements with heating elements imbedded within the RHRE), the RHRE retains heat from the previous combustion cycle and serves as the ignition aid to radical species created in the MPCC for fully controlled auto-ignition of NG.

Another factor involved in carrying out NG auto-ignition in 2-stroke engines, known from research and development over many years, is the appreciable carryover of exhaust products from cycle to cycle in these engines. Run-on after ignition cut off is attributed to residual exhaust radical species and residual exhaust thermal energy. Simulation studies in conventional engines show elimination of most of these potential RI species occurs during the exhaust of a 2-stroke combustion cycle. With ERI, MPCCs aid in storage of a fraction of these potential RI species, and enable their reactivation from a state known as frozen equilibrium during compression and aid auto-ignition in the following ignition event.

The remaining carryover species still in the combustion chamber in the next compression cycle also contribute to the ignition process by being reactivated from frozen equilibrium when heated by compression and the RHRE. Thus the essence of the RHRE 2-stroke SI ignition consists of two interrelated processes. The first is retention of heat from the previous combustion cycle and the second is to use of that heat to reactivate key residual chemical species naturally created late in combustion and quenched to frozen equilibrium during expansion of the previous combustion event. Many of these residuals would have been exhausted from the engine as contaminants without the presence of the RHRE. Instead they become part of the ignition process on being reactivated to radical species by the recycled RHRE heat and enable radical assisted spark ignition (RASI). RASI has been observed experimentally and the associated spark ignition energy (SIE) measured to be lower. RASI has been observed while measuring SIE and changing air/fuel ratio, that SIE required falls to zero if the threshold of Radical Ignition (RI) is reached. RASI experiments have measured a 33% reduction in radical assisted spark ignition voltage while a 1% reduction in the baseline caused engine instability.

Figure 5:
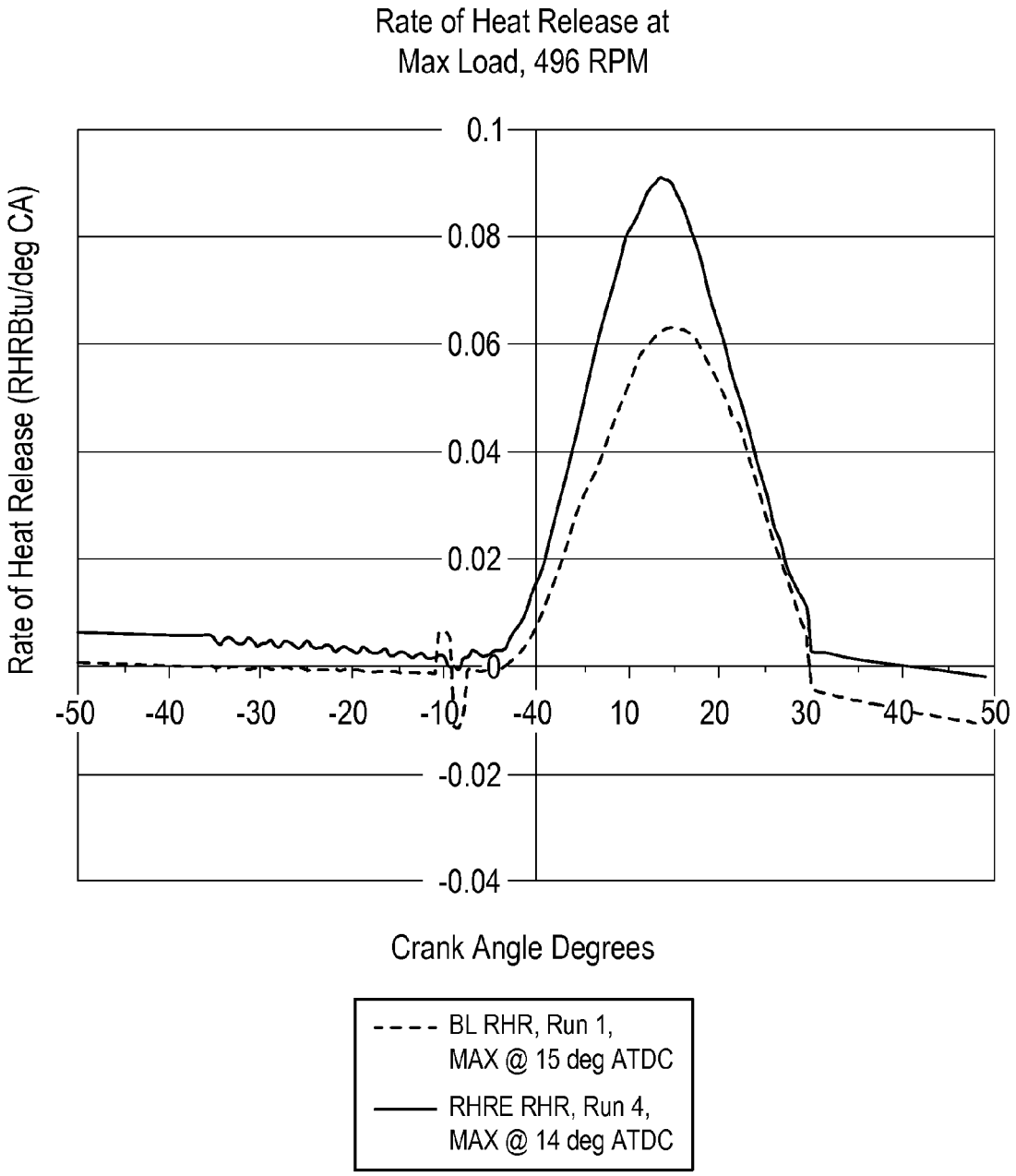
FIG. 5 shows an example of reduced spark ignition energy.

An example of reduced spark ignition energy is shown in FIG. 5, showing a NG test of the AJAX® brand DP42 engine comparing the rate of heat release and spark ignition energy of the RHRE built with the baseline at 496 RPM. The RHRE maximum rate of heat release is 43% greater while its spark ignition energy is 90% lower. Both of these traits define the primary characteristics of the RHRE. As shown in FIG. 5, a significant difference in magnitude of spark discharge, baseline is much greater using the same spark plug.

While turbo chargers are used to increase the pressure of each charge of air/fuel, the increased loading on bearings and piston components and preignition in the combustion chamber, particularly during cold start-up, decreases the operating duty cycle of the engine between maintenance cycles and overhauls, and increases NOx emissions and unburned hydrocarbons in the exhaust stream. The tendency is to operate the engines to avoid these disadvantages by retarding timing of ignition from an optimum timing that could produce best power and economy.

The regenerative heat retainer 42, produces rapid heating of the combustion chamber from a cold start condition of the engine without the need for boosting the air supply by turbocharging, for example, and creates a charge mixture capable of ignition at leaner air/fuel ratios. Extant ignition timing may then be retarded for better power while maintaining a more uniform, consistent peak firing pressure location with reduced NOx emissions. Fuel consumption is further optimized to the extent that the regenerative heat retainer will enable the engine to operate at lower exhaust CO, NOx for a given power output in view of the above considerations.

The incorporation of a heat regeneration element in the combustion chamber of an AJAX® brand engine has been explored and resulted in a significant reduction in the COV (IMEP) and lowered heat transfer losses when operating on propane. The heat regeneration element is formed to profile the upper portion of the combustion chamber, above the top surface of the piston. As a result, the heat regeneration element, which, in this example was fabricated from a single piece of material, is subjected to the flame of the combustion and attains a high operating temperature. These criteria provide a unique method of heat transfer to the air/fuel mixture to enhance flame kernel development and combustion of the remaining air/fuel mixture to improve COV (IMEP).

The heat regeneration element provides heat transfer to the entire air/fuel mixture, particularly during the compression stroke, which at any instant results in a stratified temperature of the charge. The highest temperature of the air/fuel charge is in the immediate vicinity of the surface of the heat regeneration element facing the air/fuel charge, such as that shown in FIG. 4. This temperature conditioning of the air/fuel charge enhances the flame speed, as a function of the stratified temperature. Advantageously, the highest air/fuel charge temperature is in contact with the spark plug, at position C of FIG. 4.

In lean mixtures, COV (IMEP) is influenced by several factors (i.e., mixture preparation, swirl), a high rate of development of the flame kernel is essential and can be examined by simulation. In short, upon the spark event the kernel can be rapidly developed by the flame front velocity as a function of the initial high air/fuel temperature in the vicinity of the spark plug. This process can be fully simulated based on chemical characterization/lean burn performance of the methane. The rapid development of the flame kernel provides the basis of the stability of the flame front for the remainder of the combustion event and consequential improvement in COV (IMEP).

Combustion of the lean air/fuel charge is achieved at high rates of heat release, as evidenced by the rate of change of cylinder pressure. The high rate of heat release is enabled by the instantaneous air/fuel temperature which is the direct result of heat transfer from the heat retaining element during the compression stroke. For example, characterization of methane for flame speed shows that for an 80° C. increase in temperature over the unmodified, stock engine configuration due to the heat regeneration element the flame speed has been shown to increase by 50%. Therefore, in an unmodified, stock engine where an air/fuel charge has not been conditioned, the overall burn time during the power stroke will be longer (due to lower rates of heat release), which results in higher levels of heat transfer loss to the cylinder wall and head. Increasing the rate of heat release in a controlled method is a very effective aspect for improving the combustion process for methane fuelled engines. In state-of-the-art, high rate of heat release, bi-fuel, diesel combustion technology the heat transferred to the coolant has been shown to be reduced from 19% to 10% and heat transferred to work has been shown to be increased by 14%.

The temperature stratification achieved with the heat regeneration element is particularly advantageous as the highest temperature air/fuel mixture is utilized to stabilize the initial flame kernel. Temperature stratification has not been able to be attained with increased compression ratio or allowing the stock head to overheat. Both of these approaches are undesirable for methane combustion, as they promote uncontrolled compression ignition. In other words, instantaneous temperature stratification is desirable and highly effective.

Test and simulation data indicate that RHRE fundamentally alters the combustion process in-cylinder, improving engine performance on multiple fronts without negative trade-offs. These improvements include, but are not limited to: dramatically reduced emissions, particularly NOx, even while improving engine stability and fuel economy; increased fuel economy without sacrificing power; higher power ratings for engines while complying with emissions standards thus reducing the need for additional capacity; improved lean combustion process eliminating detonations and misfires; reducing engine wear and maintenance costs; reducing or eliminating engine performance problems associated with changing natural gas composition; allowing retrofitting of existing Legacy integral engine population at a much lower cost than replacement (providing emissions than other emission-reducing solutions, significantly improving the long-term savings); and making existing engine designs, which may have been discontinued due to emissions non-compliance, viable again when equipped with RHRE technology.

Still another advantage is that modifying an existing engine to operate with the benefit of the regenerative heat retainer can be accomplished without major modification of the engine head and block elements. Typically, only the head must be modified in some minor respects to accommodate the regenerative heat retainer while preserving the original compression ratio or modifying the compression ratio as desired.

While particular embodiments of a method of modifying and a resulting modified combustion chamber in a reciprocating piston internal combustion engine are discussed above, it is to be understood that not necessarily all objects or advantages may be achieved in accordance with any particular embodiment. Thus, for example, those skilled in the art will recognize that the embodiments and examples may be embodied or carried out in a manner that achieves or optimizes one advantage or group of advantages as taught herein without necessarily achieving other objects or advantages as may be taught or suggested herein.

The skilled artisan will recognize the interchangeability of various disclosed features. In addition to the variations described herein, other known equivalents for each feature can be mixed and matched by one of ordinary skill in this art arrive at the disclosed method or resulting modified engine in accordance with principles of the present disclosure.

Although the method and modified engine described herein are disclosed in the context of certain exemplary embodiments and examples, it therefore will be understood by those skilled in the art that the present disclosure extends beyond the specifically disclosed embodiments to other alternative embodiments and/or uses of the disclosure and obvious modifications and equivalents thereof. Thus, it is intended that the scope of the present disclosure herein disclosed should not be limited by the particular disclosed embodiments described above.

We claim:

1. A method for improving combustion in a combustion chamber of a reciprocating piston internal combustion engine, the engine including a main combustion chamber arranged between a head and a reciprocating piston, the method comprising:

providing a heat retaining element between the head and the main combustion chamber, the heat retaining element being configured to reduce heat transfer from the main combustion chamber into the engine head, wherein the heat retaining element is a self-supporting structure coupled to the head, the heat retaining element including a head-facing portion substantially corresponding in shape to a portion of the head facing the main combustion chamber, wherein the heat retaining element is provided such that a gap is formed between the head-facing portion of the heat retaining element and the portion of the head facing the main combustion chamber, and wherein the heat retaining element is configured to retain heat produced by combustion of a first combustion cycle and transfer the heat to an incoming charge of a second combustion cycle.

2. The method according to claim 1, wherein the size of the gap varies in dependence on a temperature of the heat retaining element.

3. The method according to claim 2, wherein a heat transfer rate between the heat retaining element and the head varies in dependence on the size of the gap.

4. The method according to claim 1, wherein variance of the size of the gap is due to thermal expansion and contraction of the heater retaining element.

5. The method according to claim 3, wherein the size of the gap is permitted to be reduced to zero to increase the heat transfer rate between the heat retaining element and the head under engine operation conditions that cause high heating of the heat retaining element.

6. The method according to claim 1, wherein the heat retaining element is constructed from a material such that the heat retaining element has a lower thermal diffusivity than the thermal diffusivity of the head, the heat retaining element has a greater heat capacity than the heat capacity of the head, or the heat retaining element has a lower heat transfer coefficient lower than the heat transfer coefficient of the head.

7. The method according to claim 1, wherein heat transfer between the heat retaining element and a spark igniter is allowed by the spark igniter being directly connected to the heat retaining element.

8. The method according to claim 1, wherein the engine is a fluid-cooled, two-stroke, direct injected, natural gas fuel burning engine.

9. The method according to claim 8, wherein the engine includes at the head of the engine a precombustion chamber including a reaction chamber, the reaction chamber being configured to be provided with a secondary charge of air/fuel and a first spark igniter, the reaction chamber communicating with the main combustion chamber via a plurality of discharge channels configured to discharge fuel radical species from the reaction chamber into the main combustion chamber, the fuel radical species being generated from the secondary charge.

10. A heat retaining element configured to be provided between a head and a main combustion chamber of an internal combustion engine, the combustion chamber of the engine being arranged between a head and a reciprocating piston, wherein the heat retaining element is configured to reduce heat transfer from the main combustion chamber into the engine head, wherein the heat retaining element is a self-supporting structure coupled to the head, the heat retaining element including a head-facing portion substantially corresponding in shape to a portion of the head facing the main combustion chamber, and wherein the heat retaining element is provided such that a gap is formed between the head-facing portion of the heat retaining element and the portion of the head facing the main combustion chamber, and wherein the heat retaining element is configured to retain heat produced by combustion of a first combustion cycle and transfer the heat to an incoming charge of a second combustion cycle.

11. The heat retaining element according to claim 10, wherein the size of the gap varies in dependence on a temperature of the heat retaining element.

12. The heat retaining element according to claim 11, wherein a heat transfer rate between the heat retaining element and the head varies in dependence on the size of the gap, the variance of the size of the gap being dependent on thermal expansion and contraction of the heater retaining element.

13. The heat retaining element according to claim 12, wherein the size of the gap is permitted to be reduced to zero to increase the heat transfer rate between the heat retaining element and the head under engine operation conditions that cause high heating of the heat retaining element.

14. The heat retaining element according to claim 10, wherein the heat retaining element is constructed from a material such that the heat retaining element has a lower thermal diffusivity than the thermal diffusivity of the head, the heat retaining element has a greater heat capacity than the heat capacity of the head, or the heat retaining element has a lower heat transfer coefficient lower than the heat transfer coefficient of the head.

15. The heat retaining element according to claim 10, wherein heat transfer between the heat retaining element and a spark igniter is allowed by the spark igniter being directly connected to the heat retaining element.

16. The heat retaining element according to claim 10, wherein the engine is a fluid-cooled, two-stroke, direct injected, natural gas fuel burning engine.

17. The heat retaining element according to claim 10, wherein the engine includes at the head of the engine a precombustion chamber including a reaction chamber, the reaction chamber being configured to be provided with a secondary charge of air/fuel and a first spark igniter, the reaction chamber communicating with the main combustion chamber via a plurality of discharge channels configured to discharge fuel radical species from the reaction chamber into the main combustion chamber, the fuel radical species being generated from the secondary charge.

18. An internal combustion engine comprising:

a main combustion chamber arranged between a head and a reciprocating piston; and a heat retaining element provided between the head and the main combustion chamber, the heat retaining element being configured to reduce heat transfer from the main combustion chamber into the engine head, wherein the heat retaining element is a self-supporting structure coupled to the head, the heat retaining element including a head-facing portion substantially corresponding in shape to a portion of the head facing the main combustion chamber, wherein the heat retaining element is provided such that a gap is provided between the head-facing portion of the heat retaining element and the portion of the head facing the main combustion chamber, and wherein the heat retaining element is configured to retain heat produced by combustion of a first combustion cycle and transfer the heat to an incoming charge of a second combustion cycle.

* * * * *